US010322448B2

(12) United States Patent
Ren et al.

(10) Patent No.: US 10,322,448 B2
(45) Date of Patent: Jun. 18, 2019

(54) ALLOY MODIFYING AGENT FOR USE IN PREPARING METAL SEMISOLID SLURRY

(71) Applicant: ZHUHAI RUNXINGTAI ELECTRICAL CO., LTD, Zhuhai (CN)

(72) Inventors: Huaide Ren, Zhuhai (CN); Victor Wang, Zhuhai (CN); Gunan Li, Zhuhai (CN); Ying Zhang, Zhuhai (CN)

(73) Assignee: Zhuhai Runxingtai Electrical Co., Ltd, Zhuhai, Guangdong (CN)

( * ) Notice: Subject to any disclaimer, the term of this patent is extended or adjusted under 35 U.S.C. 154(b) by 80 days.

(21) Appl. No.: 15/511,457

(22) PCT Filed: Sep. 17, 2015

(86) PCT No.: PCT/CN2015/089859
§ 371 (c)(1),
(2) Date: Mar. 15, 2017

(87) PCT Pub. No.: WO2016/041510
PCT Pub. Date: Mar. 24, 2016

(65) Prior Publication Data

US 2017/0291219 A1 Oct. 12, 2017

(30) Foreign Application Priority Data

Sep. 18, 2014 (CN) ..... 2014 1 0480172

(51) Int. Cl.
*C22C 1/02* (2006.01)
*B22D 27/20* (2006.01)
(Continued)

(52) U.S. Cl.
CPC ..... *B22D 27/20* (2013.01); *B22D 17/007* (2013.01); *B22D 21/007* (2013.01); *B22D 21/04* (2013.01);
(Continued)

(58) Field of Classification Search
CPC ..... B22D 27/20; C22C 1/026; C22C 21/02; C22C 21/04
See application file for complete search history.

(56) References Cited

U.S. PATENT DOCUMENTS 6,908,590 B2 * 6/2005 DasGupta ..... B22D 17/007 148/417
6,918,427 B2 * 7/2005 Yurko ..... B22D 1/00 164/113
(Continued)

FOREIGN PATENT DOCUMENTS

CA 2459677 A1 2/2003
CN 1262334 8/2000
(Continued)

OTHER PUBLICATIONS

JP-2010185409-A Machine Translation (Year: 2010).*
(Continued)

*Primary Examiner* — Tima M McGuthry-Banks
(74) *Attorney, Agent, or Firm* — Ladas & Parry, LLP

(57) ABSTRACT

An alloy modifying agent for use in preparing a metal semisolid slurry, where the components and mass ratio thereof is silicon:iron:copper:manganese:magnesium:zinc:titanium:lead:aluminum having a mass ratio of (6.05-6.95):(0.15-0.45):(0.12-0.65):(0.002-0.006):(0.001-0.5):(0.025-0.05):(0.002-0.08):(0.002-0.06):(90.5-93.2). Also, a method for preparing the alloy modifying agent and a method for using the alloy modifying agent. The alloy modifying agent is capable of increasing the solid-liquid ratio and the spherical crystal content of the semisolid slurry, increasing the preparation efficiency of the semisolid slurry and the quality of the slurry, and ensuring the quality of a final die casting product.

15 Claims, 2 Drawing Sheets

(51) Int. Cl.

| | |
|---|---|
| ***C22C 21/02*** | (2006.01) |
| ***C22C 21/04*** | (2006.01) |
| ***B22D 27/00*** | (2006.01) |
| ***B22D 21/04*** | (2006.01) |
| ***B22D 21/00*** | (2006.01) |
| ***B22D 17/00*** | (2006.01) |

(52) U.S. Cl.
CPC ..... *B22D 27/00* (2013.01); *C22C 1/026* (2013.01); *C22C 21/02* (2013.01); *C22C 21/04* (2013.01)

(56) References Cited

U.S. PATENT DOCUMENTS

| | | | | |
|---|---|---|---|---|
| 7,152,658 | B2 | 12/2006 | Hartmann et al. | |
| 7,509,993 | B1 | 3/2009 | Turng et al. | |
| 2003/0037900 | A1 | 2/2003 | Winterbottom et al. | |
| 2003/0196775 | A1 | 10/2003 | Kamm et al. | |
| 2004/0121180 | A1 * | 6/2004 | Wittebrood ..... | B23K 1/14 428/652 |

FOREIGN PATENT DOCUMENTS

| | | | | |
|---|---|---|---|---|
| CN | 1416982 | A | | 5/2003 |
| CN | 1994622 | A | | 7/2007 |
| CN | 101007342 | | | 8/2007 |
| CN | 101229582 | | | 7/2008 |
| CN | 101537480 | | | 9/2009 |
| CN | 101537480 | A | | 9/2009 |
| CN | 101602099 | | | 12/2009 |
| CN | 101608270 | | | 12/2009 |
| CN | 101817064 | | | 9/2010 |
| CN | 101817064 | A | | 9/2010 |
| CN | 102345023 | | | 2/2012 |
| CN | 102634700 | A | | 8/2012 |
| CN | 103173663 | A | | 6/2013 |
| CN | 104259417 | A | | 1/2015 |
| CN | 104259418 | A | | 1/2015 |
| JP | 2010185409 | A | * | 8/2010 |
| KR | 100727178 | B1 | * | 6/2007 |
| KR | 1020120131583 | | * | 12/2012 |
| WO | 2004061140 | | | 7/2004 |
| WO | 2005056845 | A2 | | 6/2005 |
| WO | WO-2013045129 | A1 * | | 4/2013 ..... B23K 1/0012 |

OTHER PUBLICATIONS

KR 101795035 B1 Machine Translation. Patent Family Including KR 2012-0131586-A (Year: 2012).*
KR 727178-B1 Machine Translation (Year: 2007).*
First Office Action for Chinese Application No. 201410480172.3 dated Oct. 10, 2015 with English machine translation provided by Espacenet Global Dossier.
First Search for Chinese Application No. 201410480172.3 dated Sep. 24, 2015.
Notification to Grant Patent Right for Chinese Application No. 201410480172.3 dated Feb. 2, 2016 with English machine translation provided by Espacenet Global Dossier.
Written Opinion for PCT/CN2015/089859 dated Dec. 28, 2015 and its English translation from WIPO.
International Preliminary Report on Patentability (IPRP; Ch. 1) for PCT/CN2015/089859 dated Mar. 30, 2017 and its English translation from WIPO.
Written Opinion for PCT/CN2015/089861 dated Dec. 28, 2015 and its English translation from WIPO.
International Preliminary Report on Patentability (IPRP; Ch. 1) for International Preliminary dated Apr. 6, 2017 and its English translation from WIPO.
International Search Report for PCT/CN2015/089859 dated Nov. 28, 2015 and its English machine translation provided by WIPO.
Written Opinion for PCT/CN2015/089859 dated Nov. 28, 2015 and its English machine translation by Google translate.
U.S. Appl. No. 15/511,457, dated Mar. 15, 2007, Ren et al.
International Search Report for PCT/CN2015/089861 dated Dec. 28, 2015 and its English machine translation provided by WIPO.
Written Opinion for PCT/CN2015/089861 dated Dec. 28, 2015 and its English machine translation by Google translate.
From CN201410492077.5, 1st Office Action, dated Sep. 10, 2015, and its English translation from Espacenet.
From CN201410492077.5, 1st Search Report, dated Sep. 24, 2015.
Wu, Shusen et al., Machinist Metal Forming, "Semi-solid Die-casting Forming Technique for High Silicon-aluminum Alloy", No. 9, Dec. 31, 2010, ISSN: ISSN 1674-165X. English translation provided by applicant.

* cited by examiner

ALLOY MODIFYING AGENT FOR USE IN PREPARING METAL SEMISOLID SLURRY

CROSS-REFERENCE TO RELATED APPLICATION

This application is the U.S. National phase of PCT Application No. PCT/CN2015/089859 filed on Sep. 17, 2015, which claims a priority to the Chinese Patent Application No. 201410480172.3 filed on Sep. 18, 2014, the disclosures of which are hereby incorporated by reference in their entireties.

TECHNICAL FIELD

The present invention relates to an alloy modifying agent and a preparation method thereof, and in particular to an alloy modifying agent for preparing metal semisolid slurry and methods of preparation and use thereof.

BACKGROUND ART

The semisolid die-casting technology, developed in the early 1970s, has deeply changed the traditional die-casting method. Domestic and foreign Scholars have put forward many processes for preparing semisolid metal slurry, such as mechanical stirring, electromagnetic stirring, controlled solidification, strain activation, powder metallurgy and other methods. Many of the existing semisolid metal slurrying methods suffer from the following shortcomings: it is difficult to control the solid-liquid ratio of the semisolid slurry, and the spherical crystal structures take a small share in the prepared semisolid slurry; and it is likely to result in cold shut and misrun in the semisolid die-casting, especially nodularity of the casting structure is low, impacting the molding of the casting. Those shortcomings result in low quality of products prepared by the semisolid die-casting process.

At present, studies on the semisolid slurrying process in the industry focus on equipment and methods for preparing semisolid slurry, with few studies on improving the quality and product performance of semisolid slurry by adding an alloy modifying agent. Moreover, the existing alloy modifying agents are unable to effectively improve the solid-liquid ratio and spherical crystal content of semisolid slurry.

Contents of the present invention

In order to solve the above technical problems, the present invention provides an alloy modifying agent for preparing metal semisolid slurry and methods of preparation and use thereof.

According to one aspect of the present invention, an alloy modifying agent is provided with the following components and mass ratio thereof: specifically, silicon, iron, copper, manganese, magnesium, zinc, titanium, lead and aluminum, with a mass ratio of (6.05 to 6.95):(0.15 to 0.45):(0.12 to 0.65):(0.002 to 0.006):(0.001 to 0.5):(0.025 to 0.05):(0.002 to 0.08): (0.002 to 0.06):(90.5 to 93.2).

Wherein, the alloy modifying agent is a solid modifying agent additive ring

According to another aspect of the present invention, a method for preparing the alloy modifying agent is provided. The steps of the preparation method are:

(1) adding pure aluminum having a purity of 99.99% to a graphite crucible, and placing the graphite crucible into an electric furnace to heat to 735° C. to 765° C. to melt the pure aluminum;

(2) adding metal copper, aluminum magnesium alloy, titanium alloy additive and metal silicon into the graphite crucible, so that the mass ratio of the components in the graphite crucible, i.e., silicon, iron, copper, manganese, magnesium, zinc, titanium, lead and aluminum, is (6.05 to 6.95):(0.15 to 0.45):(0.12 to 0.65):(0.002 to 0.006):(0.001 to 0.5):(0.025 to 0.05):(0.002 to 0.08): (0.002 to 0.06): (90.5 to 93.2);

(3) melting and then refining the alloy in the graphite crucible to obtain the alloy modifying agent; and then sampling and obtaining the chemical composition and metallographic structure of the alloy modifying agent by spectral analysis;

(4) casting the liquid alloy modifying agent with uniform composition into a metal mold to obtain an alloy modifying agent bar; and (5) machining, on a lathe, the alloy modifying agent bar into modifying agent additive rings of different masses.

Wherein, in the step (2), the mass ratio of the components in the graphite crucible, i.e., silicon, iron, copper, manganese, magnesium, zinc, titanium, lead and aluminum, is (6.65 to 6.75):(0.18 to 0.32):(0.35 to 0.55):(0.002 to 0.005):(0.004 to 0.45):(0.03 to 0.045):(0.06 to 0.08):(0.04 to 0.06):(91.0 to 93.0).

Wherein, in the step (2), the mass ratio of the components in the graphite crucible, i.e., silicon, iron, copper, manganese, magnesium, zinc, titanium, lead and aluminum, is 6.70:(0.20 to 0.30):(0.40 to 0.50):0.002:(0.05 to 0.40):(0.03 to 0.04): 0.07: 0.05: 91.15.

According to a third aspect of the present invention, an method for using the alloy modifying agent is provided. The method for using the alloy modifying agent is: in a slurrying process of the metal semisolid slurry, adding the alloy modifying agent to the semisolid slurry at a mass ratio of 0.5% to 3%, so that spherical crystals are formed quickly in the semisolid slurry and the solid-liquid ratio is increased.

Wherein, the alloy modifying agent is added to the semisolid slurry at a mass ratio of 0.8% to 2.2%.

Wherein, the alloy modifying agent is added to the semisolid slurry at a mass ratio of 1%; and the semisolid slurry is aluminum alloy semisolid slurry.

The present invention has the following advantages and beneficial effects:

(1) With regard to the alloy modifying agent for preparing metal semisolid slurry of the present invention, adding the alloy modifying agent into the molten semisolid slurry can greatly increase the solid-liquid ratio and the spherical crystal content of the semisolid slurry, and improve the preparation efficiency of the semisolid slurry and the quality of the slurry, ensuring the quality of a final die-cast product. The specific beneficial effects are as seen in Examples and as shown in Table 1.

(2) The alloy modifying agent of the present invention improves the solid-liquid ratio and the nodularity of the semisolid slurry in the slurrying process of the semisolid slurry, so that the semisolid slurry has excellent die-casting performance, ensuring the excellent quality of the die-cast product.

(3) The preparation method of the alloy modifying agent of the present invention is simple and easy to operate, and capable of preparing the alloy modifying agent on a large scale in a simple equipment. Furthermore, the preparation method is low in cost and energy consumption, reducing the production cost.

DETAILED DESCRIPTION OF THE EMBODIMENTS

In order to make the objectives, technical solutions and advantages of the present invention clearer, the present invention will be further described in detail by way of Examples.

EXAMPLE 1

The technical solutions employed by the present invention are an alloy modifying agent for preparing metal semisolid slurry and methods of preparation and use thereof. The steps of the preparation method are:

(1) adding 5 Kg of pure aluminum having a purity of 99.99% to a graphite crucible, and placing the graphite crucible into an electric furnace to heat to 750° C. to melt the pure aluminum;

(2) adding metal copper, aluminum magnesium alloy, titanium alloy additive and metal silicon into the graphite crucible, so that the mass ratio of the components in the graphite crucible, i.e., silicon, iron, copper, manganese, magnesium, zinc, titanium, lead and aluminum, is 6.05:0.15:0.12:0.002:0.5:0.025:0.002:0.002:90.5;

(3) melting and then refining the alloy in the graphite crucible to obtain the liquid alloy modifying agent; and then sampling and obtaining the chemical composition and metallographic structure of the alloy modifying agent by spectral analysis;

(4) casting the liquid alloy modifying agent with uniform composition into a metal mold to obtain an alloy modifying agent bar;

(5) machining, on a lathe, the alloy modifying agent bar into modifying agent additive rings of different masses.

The content of the components of the alloy modifying agent prepared in this Example is the ratio of the components as shown in the step (2).

Figure 1:
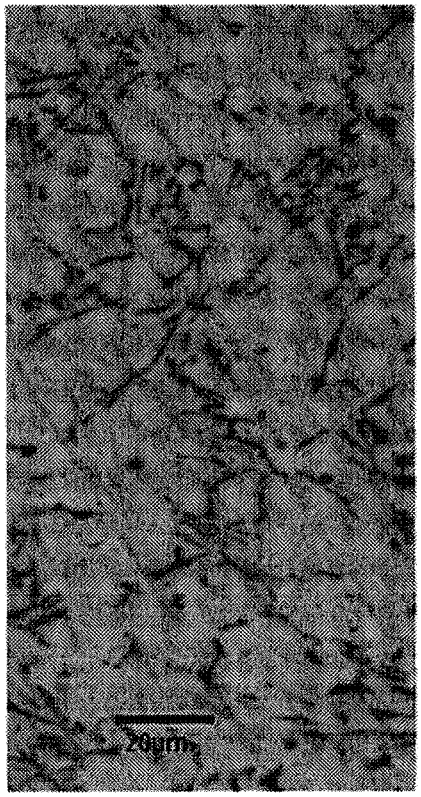
FIG. 1 is a 100× metallographic structure diagram obtained by sampling and analysis of the semisolid slurry processed by an alloy modifying agent according to Example 1 of the present invention.

An method of use of the alloy modifying agent is: adding the alloy modifying agent ring obtained in the step (5) into the semisolid slurry at a mass ratio of 1%, to obtain the semisolid slurry processed by the alloy modifying agent. After sampling and analyzing the semisolid slurry, a 100× metallographic structure diagram is obtained, as shown in FIG. 1.

Mass percents of the components in the semisolid slurry are: 6.5% of silicon, 0.8% of copper, 0.9% of zinc, 0.8% nickel, 0.4% of magnesium, 0.5% of iron, with the balance of aluminum and inevitable trace impurities.

EXAMPLE 2

An alloy modifying agent for preparing metal semisolid slurry and methods of preparation and use thereof are provided. The steps of preparation method are:

(1) adding 5 Kg of pure aluminum having a purity of 99.99% to a graphite crucible, and placing the graphite crucible into an electric furnace to heat to 765° C. to melt the pure aluminum;

(2) adding metal copper, aluminum magnesium alloy, titanium alloy additive and metal silicon into the graphite crucible, so that the mass ratio of the components in the graphite crucible, i.e., silicon, iron, copper, manganese, magnesium, zinc, titanium, lead and aluminum, is 6.95:0.45:0.65:0.006:0.001:0.05:0.08:0.06:93.2;

(3) melting and then refining the alloy in the graphite crucible to obtain the liquid alloy modifying agent; and then sampling and obtaining the chemical composition and metallographic structure of the alloy modifying agent by spectral analysis;

(4) casting the liquid alloy modifying agent with uniform composition into a metal mold to obtain an alloy modifying agent bar;

(5) machining, on a lathe, the alloy modifying agent bar into modifying agent additive rings of different masses.

The content of the components of the alloy modifying agent prepared in this Example is the ratio of the components as shown in the step (2).

Figure 2:
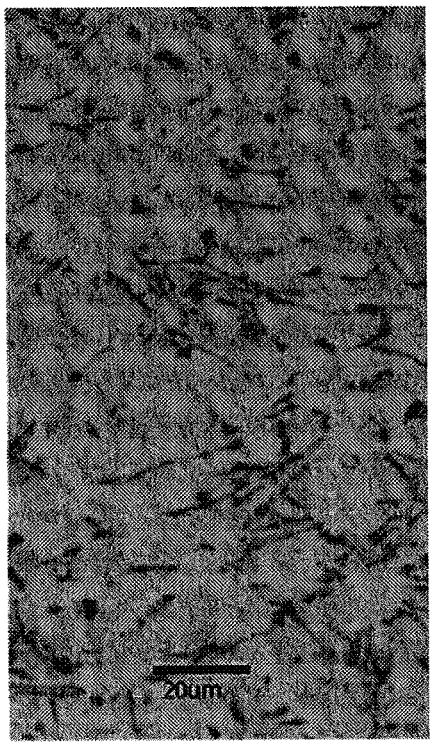
FIG. 2 is a 100× metallographic structure diagram obtained by sampling and analysis of the semisolid slurry processed by an alloy modifying agent according to Example 2 of the present invention.

An method of use of the alloy modifying agent is: adding the alloy modifying agent ring obtained in the step (5) into the semisolid slurry at a mass ratio of 1%, to obtain the semisolid slurry processed by the alloy modifying agent. After sampling and analyzing the semisolid slurry, a 100× metallographic structure diagram is obtained, as shown in FIG. 2.

Mass percents of the components in the semisolid slurry are: 6.5% of silicon, 0.8% of copper, 0.9% of zinc, 0.8% nickel, 0.4% of magnesium, 0.5% of iron, with the balance of aluminum and inevitable trace impurities.

EXAMPLE 3

An alloy modifying agent for preparing metal semisolid slurry and methods of preparation and use thereof are provided. The steps of preparation method are:

(1) adding 5 Kg of pure aluminum having a purity of 99.99% to a graphite crucible, and placing the graphite crucible into an electric furnace to heat to 735° C. to melt the pure aluminum;

(2) adding metal copper, aluminum magnesium alloy, titanium alloy additive and metal silicon into the graphite crucible, so that the mass ratio of the components in the graphite crucible, i.e., silicon, iron, copper, manganese, magnesium, zinc, titanium, lead and aluminum, is 6.70:0.20:0.40:0.005:0.35:0.04:0.07:0.05:91.15;

(3) melting and then refining the alloy in the graphite crucible to obtain the liquid alloy modifying agent; and then sampling and obtaining the chemical composition and metallographic structure of the alloy modifying agent by spectral analysis;

(4) casting the liquid alloy modifying agent with uniform composition into a metal mold to obtain an alloy modifying agent bar;

(5) machining, on a lathe, the alloy modifying agent bar into modifying agent additive rings of different masses.

The content of the components of the alloy modifying agent prepared in this Example is the ratio of the components as shown in the step (2).

An method of use of the alloy modifying agent is: adding the alloy modifying agent ring obtained in the step (5) into the semisolid slurry at a mass ratio of 3%, to obtain the semisolid slurry processed by the alloy modifying agent.

Figure 3:
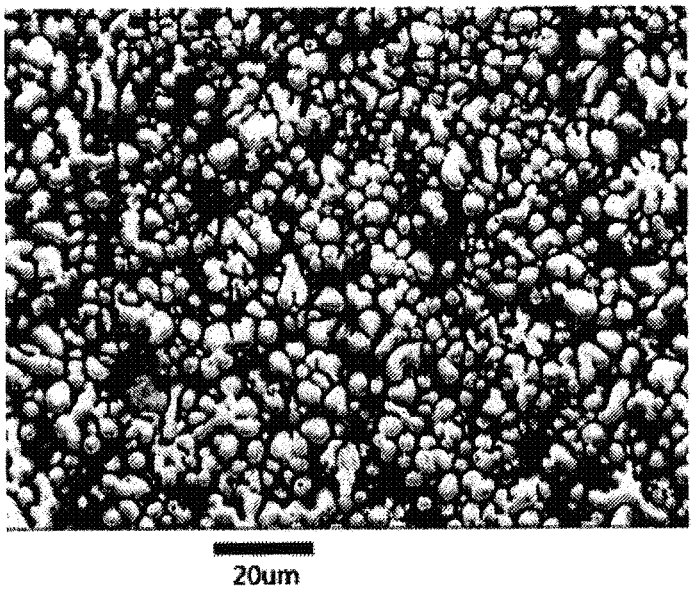
FIG. 3 is a 100× metallographic structure diagram obtained by sampling and analysis of the semisolid slurry processed by an alloy modifying agent according to Example 3 of the present invention.

After sampling and analyzing the semisolid slurry, a 100× metallographic structure diagram is obtained, as shown in FIG. 3.

Mass percents of the components in the semisolid slurry are: 6.5% of silicon, 0.8% of copper, 0.9% of zinc, 0.8% nickel, 0.4% of magnesium, 0.5% of iron, with the balance of aluminum and inevitable trace impurities.

It can be seen from the metallographic structure diagrams of the semisolid slurry obtained in the above Examples 1 to 3 that there are a great many of spherical crystal structures in the resultant semisolid slurry after being processed by adding the alloy modifying agent of the present invention, thus effectively solving the problem of low nodularity of crystal particles of the semisolid slurry, so that the semisolid slurry has excellent die-casting machining performance, and the production efficiency of the semisolid slurry is improved.

The semisolid slurry processed by the alloy modifying agents in the Examples 1, 2 and 3 is die cast by a die-casting machine. The semisolid slurry is poured into a 1000T die-casting machine for die casting at 585° C. to 595° C., at a speed of 4 m/s, and under a system pressure of 15 MPa and a boost pressure of 28 MPa. A standard sample with a diameter of 10 mm obtained after the die casting is tested for the mechanical properties. The test method includes: testing the standard sample with a diameter of 10 mm at room temperature with a tensile testing machine by the room temperature tensile test method (GB/T228.1). The specific test results are as shown in Table 1.

TABLE 1

| Items | | Example 1 | Example 2 | Example 3 |
|---|---|---|---|---|
| Mechanical properties | Tensile strength MPa | 181.5 | 176.6 | 183.1 |
| | Break elongation % | 5.3 | 5.9 | 5.6 |

It is known from Table 1 that the product of the semisolid slurry after being processed by the alloy modifying agent of the present invention has excellent mechanical properties and can meet the requirements on the quality of a die-cast product. The semisolid slurry has excellent application effects, ensuring the quality of the product.

Finally, it should be noted that: obviously, the above Examples are merely examples provided for clearly illustrating the present invention, but not for limiting the embodiments. For a person of ordinary skill in the art, variations or modifications in other different forms may be made on the basis of the above illustration. It is neither necessary nor able to exhaustively list all of the embodiments. All obvious variations or modifications derived accordingly should be regarded as falling into the protection scope of the present invention.

INDUSTRIAL APPLICABILITY (1) With regard to the alloy modifying agent for preparing metal semisolid slurry of the present invention, adding the alloy modifying agent into the molten semisolid slurry can greatly increase the solid-liquid ratio and the spherical crystal content of the semisolid slurry, and improve the preparation efficiency of the semisolid slurry and the quality of the slurry, ensuring the quality of a final die-cast product.

(2) The alloy modifying agent of the present invention improves the solid-liquid ratio and the nodularity of the semisolid slurry in the slurrying process of the semisolid slurry, so that the semisolid slurry has excellent die-casting performance, ensuring the excellent quality of the die-cast product.

(3) The preparation method of the alloy modifying agent of the present invention is simple and easy to operate, and capable of preparing the alloy modifying agent on a large scale in a simple equipment. Furthermore, the preparation method is low in cost and energy consumption, reducing the production cost.

The invention claimed is:

1. A method for preparing an alloy modifying agent, comprising:

(1) adding pure aluminum having a purity of 99.99% to a graphite crucible, and placing the graphite crucible into an electric furnace to heat to 735° C. to 765° C. to melt the pure aluminum;

(2) adding metal copper, aluminum magnesium alloy, titanium alloy additive and metal silicon into the graphite crucible, so that the mass ratio of the components in the graphite crucible, silicon, iron, copper, manganese, magnesium, zinc, titanium, lead and aluminum, is (6.05 to 6.95):(0.15 to 0.45):(0.12 to 0.65):(0.002 to 0.006):(0.001 to 0.5):(0.025 to 0.05):(0.002 to 0.08):(0.002 to 0.06):(90.5 to 93.2);

(3) melting and then refining the alloy in the graphite crucible to obtain the alloy modifying agent; and then sampling and obtaining the chemical composition and metallographic structure of the alloy modifying agent by spectral analysis;

(4) casting the liquid alloy modifying agent with uniform composition into a metal mold to obtain an alloy modifying agent bar; and (5) machining, on a lathe, the alloy modifying agent bar into modifying agent additive rings of different masses.

2. A method for using the alloy modifying agent prepared by the preparation method according to claim 1, comprising: in a slurrying process of a metal semisolid slurry, adding the alloy modifying agent to the semisolid slurry at a mass ratio of 0.5% to 3%, so that spherical crystals are formed quickly in the semisolid slurry and the solid-liquid ratio is increased.

3. The method for using the alloy modifying agent according to claim 2, wherein the alloy modifying agent is added to the semisolid slurry at a mass ratio of 0.8% to 2.2%.

4. The method for using the alloy modifying agent according to claim 3, wherein the alloy modifying agent is added to the semisolid slurry at a mass ratio of 1%; and the semisolid slurry is aluminum alloy semisolid slurry.

5. The method for preparing the alloy modifying agent according to claim 1, wherein in the step (2), the mass ratio of the components in the graphite crucible, silicon, iron, copper, manganese, magnesium, zinc, titanium, lead and aluminum, is (6.65 to 6.75):(0.18 to 0.32):(0.35 to 0.55):(0.002 to 0.005):(0.004 to 0.45):(0.03 to 0.045):(0.06 to 0.08):(0.04 to 0.06):(91.0 to 93.0).

6. A method for using an alloy modifying agent prepared by the preparation method according to claim 5, comprising: in a slurrying process of a metal semisolid slurry, adding the alloy modifying agent to the semisolid slurry at a mass ratio of 0.5% to 3%, so that spherical crystals are formed quickly in the semisolid slurry and the solid-liquid ratio is increased.

7. The method for using the alloy modifying agent according to claim 6, wherein the alloy modifying agent is added to the semisolid slurry at a mass ratio of 0.8% to 2.2%.

8. The method for using the alloy modifying agent according to claim 7, wherein the alloy modifying agent is added to the semisolid slurry at a mass ratio of 1%; and the semisolid slurry is aluminum alloy semisolid slurry.

9. The method for preparing the alloy modifying agent according to claim 5, wherein in the step (2), the mass ratio of the components in the graphite crucible, silicon, iron, copper, manganese, magnesium, zinc, titanium, lead and aluminum, is 6.70:(0.20 to 0.30):(0.40 to 0.50):0.002:(0.05 to 0.40):(0.03 to 0.04):0.07:0.05:91. 15.

10. A method for using the alloy modifying agent prepared by the preparation method according to claim 9, comprising: in a slurrying process of a metal semisolid slurry, adding the alloy modifying agent to the semisolid slurry at a mass ratio of 0.5% to 3%, so that spherical crystals are formed quickly in the semisolid slurry and the solid-liquid ratio is increased.

11. The method for using the alloy modifying agent according to claim 10, wherein the alloy modifying agent is added to the semisolid slurry at a mass ratio of 0.8% to 2.2%.

12. The method for using the alloy modifying agent according to claim 11, wherein the alloy modifying agent is added to the semisolid slurry at a mass ratio of 1%; and the semisolid slurry is aluminum alloy semisolid slurry.

13. A method for using an alloy modifying agent, comprising: in a slurrying process of a metal semisolid slurry, adding the alloy modifying agent to the semisolid slurry at a mass ratio of 0.5% to 3%, so that spherical crystals are formed quickly in the semisolid slurry and the solid-liquid ratio is increased, wherein, the components of the alloy modifying agent comprises silicon, iron, copper, manganese, magnesium, zinc, titanium, lead and aluminum, with a mass ratio of (6.05 to 6.95):(0.15 to 0.45):(0.12 to 0.65):(0.002 to 0.006):(0.001 to 0.5):(0.025 to 0.05):(0.002 to 0.08):(0.002 to 0.06):(90.5 to 93.2); wherein the alloy modifying agent is a solid modifying agent additive ring.

14. The method for using the alloy modifying agent according to claim 13, wherein the alloy modifying agent is added to the semisolid slurry at a mass ratio of 0.8% to 2.2%.

15. The method for using the alloy modifying agent according to claim 14, wherein the alloy modifying agent is added to the semisolid slurry at a mass ratio of 1%; and the semisolid slurry is aluminum alloy semisolid slurry.

* * * * *